US005499936A

United States Patent [19]

McElroy, Jr. et al.

[11] Patent Number: 5,499,936

[45] Date of Patent: Mar. 19, 1996

[54] MONOLITHIC METALLIC DRIVE SHAFTS WHICH ARE RESISTANT TO CORROSION AND WEAR

[75] Inventors: Kennedy K. McElroy, Jr., Lindenhurst, Ill.; James Bonifield, New Berlin; Dale Boschke, Pewaukee, both of Wis.; Richard A. Krajewski, Calhoun, Ga.

[73] Assignee: Outboard Marine Corporation, Waukegan, Ill.

[21] Appl. No.: 371,954

[22] Filed: Jan. 12, 1995

[51] Int. Cl.[6] ..... B63H 23/34

[52] U.S. Cl. ..... 440/83; 464/179; 148/212; 148/318; 148/904

[58] Field of Search ..... 440/83, 89; 464/179; 148/212, 213, 225, 230, 318, 319, 904

[56] References Cited

U.S. PATENT DOCUMENTS

| | | | |
|---|---|---|---|
| 3,344,817 | 10/1967 | Connard | 148/318 |
| 3,952,686 | 4/1976 | Pichl | 440/83 |
| 4,191,363 | 3/1980 | Shank | 266/129 |
| 5,085,713 | 2/1992 | Morishita et al. | 148/319 |

FOREIGN PATENT DOCUMENTS

| | | |
|---|---|---|
| 1302948 | 2/1962 | Germany . |
| 2855487 | 7/1980 | Germany . |
| 54071025 | 6/1979 | Japan . |
| 80015532 | 4/1980 | Japan . |
| 59136416 | 8/1984 | Japan . |
| 1464846 | 2/1977 | United Kingdom . |

OTHER PUBLICATIONS

"Guide to Selecting Engineering Materials", *Advanced Mat's & Processes,* vol. 137, Issue 6, pp. 82–83 (Jun. 1990).

"Selecting Materials for Wear Reistance", *Advanced Mat'ls & Processes,* vol. 137, Issue 6, pp. 117–118 (Jun. 1990).

Kirk–Othmer, *Concise Encyclopedia of Chemical Technology,* pp. 753–754 (1985).

*Machine Design,* pp. 941–945 (Jun. 1991).

*Machine Design,* pp. 25–30 (Apr. 1980).

*Primary Examiner*—Jesus D. Sotelo

*Attorney, Agent, or Firm*—Synnestvedt & Lechner

[57] ABSTRACT

A monolithic metallic drive shaft for a marine propulsion device is disclosed which is resistant to corrosion. The drive shaft comprises proximal and distal end portions, each of which has a predetermined surface hardness. The surface hardness of one of the proximal and distal end portions is greater than the surface hardness of the other of the proximal and distal end portions.

20 Claims, 2 Drawing Sheets

MONOLITHIC METALLIC DRIVE SHAFTS WHICH ARE RESISTANT TO CORROSION AND WEAR

FIELD OF THE INVENTION

The present invention relates to corrosion- and wear-resistant monolithic metallic drive shafts and processes for their production. More particularly, the present invention relates to monolithic metallic drive shafts which comprise a first portion which is resistant to corrosion and a second portion which is resistant to wear.

BACKGROUND OF THE INVENTION

Metallic drive shafts are an integral and necessary part of propulsion devices which operate to transmit motion to an otherwise stationary object. Examples of such drive shafts include propeller shafts for use in marine propulsion devices, such as outboard motors.

Metallic drive shafts, including propeller shafts, are generally subjected to harsh environments. In this connection, drive shafts generally comprise proximal and distal ends, one of which is typically engaged to a motion-generating means, for example, a propeller means. The area proximate the propeller means is generally exposed in use to a corrosive environment, for example, a marine environment, including sea water. The corrosive environment typically causes corrosion of the area which is proximate the propeller means.

The other of the proximal and distal ends of drive shafts is typically drivingly engaged with a motor driving means, for example, an outboard motor, for driving the shaft. Engagement of the shaft with the motor driving means is accomplished generally by frictional and/or gear engagement. Since it is often desirable to drive the shaft at high speeds, undesired wear and/or galling generally occurs in the area of the drive shaft which is proximate the motor driving means. (Galling is a severe form of adhesive wear that shows up as torn areas of the metal surface. Unless stated otherwise, reference herein to "wear" generally refers also to "galling".)

Drive shafts are generally rotatably supported at one or more positions along the length of the shaft, located between the proximal and distal ends. This support permits rotation of the shaft about its longitudinal axis as the shaft is being driven by the motor driving means. Rotatable support can be provided, for example, by roller needle bearings which frictionally contact needle bearing surfaces of the shaft. Such frictional contact can cause also wear of the shaft. The wear can be so severe as to ultimately cause failure of the propeller shaft.

Efforts have been made to produce drive shafts which can withstand harsh environments, including corrosive and wear environments. For example, drive shafts may be manufactured from stainless steel, such as austenitic stainless steel, which is generally resistant to corrosion from marine environments, including sea water.

However, stainless steel generally lacks the necessary hardness to withstand wear conditions of the type which are described above. To obtain the necessary hardness, stainless steel can be surface-hardened, for example, by exposure to surface-hardening agents. Such surface-hardening techniques include, for example, nitriding.

Although surface-hardening procedures generally produce stainless steel which has desirable wear-resistance, such procedures also diminish the inherent ability of the steel to resist corrosion. Accordingly, surface-hardened drive shafts will generally possess desirable resistance to wear, but will possess also poor resistance to corrosion.

Attempts have been made to produce drive shafts which comprise both corrosion-resistant stainless steel and wear-resistant surface-hardened stainless steel. For example, drive shafts for marine propulsion devices generally comprise a first portion (A) that is corrosion-resistant (stainless steel) and which is welded to a second portion (B) this is wear-resistant (surface-hardened stainless steel). This type of drive shaft is depicted in FIGS. 1 and 2.

However, known techniques of welding together different metals to produce drive shafts which are both corrosion- and wear-resistant suffer from various drawbacks. For example, welding operations generally require that costly secondary operations be performed to provide a usable drive shaft, including machining, heat treating and straightening operations.

Other attempts to overcome the problems associated with corrosion and wear of propeller shafts include providing a shaft which has desirable hardness and covering with a water-resistant sheath that portion of the shaft which in use is exposed to a marine environment. U.S. Pat. No. 3,952,686 describes such an arrangement, wherein the sheath comprises a sleeve, spokes, and a hub which are secured to the shaft and which are made from aluminum or an alloy thereof. This arrangement suffers from drawbacks in that access to the shaft is undesirably hindered. Moreover, additional manufacturing operations are required for the production of the protective sheath.

U.S. Pat. No. 4,604,068 discloses the use of a sacrificial anode for protecting marine propulsion device components from corrosion. This technique suffers from drawbacks in that depleted anodes must be replaced regularly and that the propeller shaft bearing housing must be removed from the lower gearcase to replace the anode.

The present invention exploits the corrosion-resistance of stainless steel and the wear-resistance of surface-hardened stainless steel and provides monolithic drive shafts which are resistant to both corrosion and wear.

SUMMARY OF THE INVENTION

In accordance with the invention, there is provided a monolithic metallic drive shaft which is resistant to corrosion. The drive shaft comprises proximal and distal end portions, each of which has a predetermined surface hardness. The surface hardness of one of the proximal and distal end portions is greater than the surface hardness of the other of the proximal and distal end portions.

In preferred form, the drive shaft is for a marine propulsion device and comprises a first portion which in use is subjected to a substantially corrosive environment. In preferred form also, the drive shaft comprises a second portion which in use is subjected to an environment which is less corrosive than the environment to which the first portion is subjected.

Another aspect of the invention relates to a process for producing a drive shaft. The process involves providing a corrosion-resistant, monolithic metallic shaft which comprises a first portion which in use is subjected to a substantially corrosive environment and a second portion which in use is subjected to an environment which is less corrosive than the environment to which the first portion is subjected. The second portion, which includes a bearing surface, is surface hardened.

BRIEF DESCRIPTION OF THE DRAWINGS

For the purpose of illustrating the invention, there are shown in the drawings forms which are presented preferred; it being understood, however, that this invention is not limited to the precise arrangement and instrumentality shown.

DETAILED DESCRIPTION OF THE INVENTION

Figure 1:
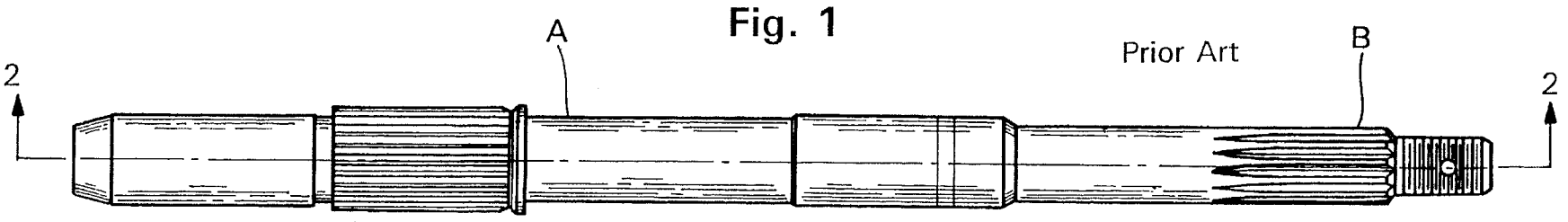
FIG. 1 is a plan view of a propeller shaft according to the prior art.
Figure 2:
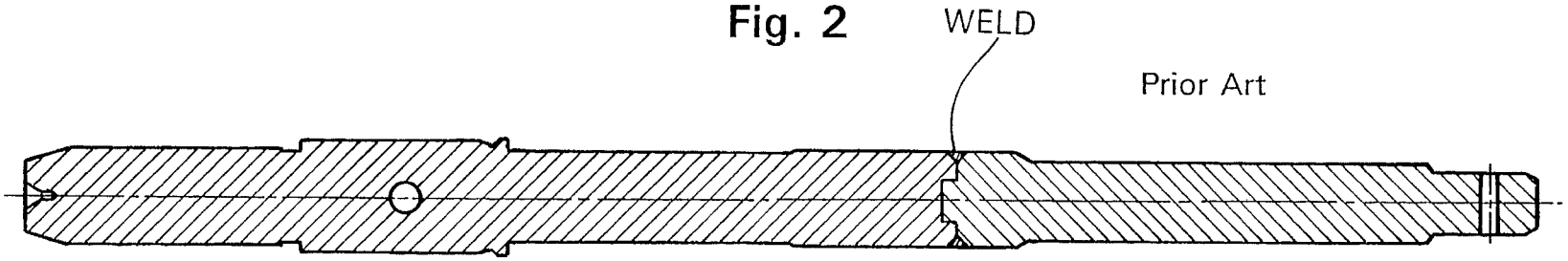
FIG. 2 is a sectional view taken along line 2—2 in FIG. 1.
Figure 3:
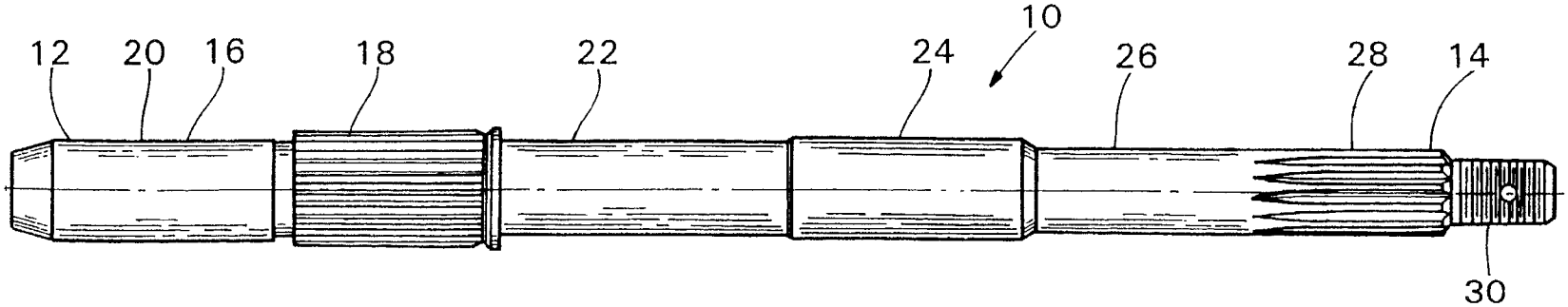
FIG. 3 is a plan view of a propeller shaft according to the present invention.

Referring to the drawings, FIG. 3 is a plan view of a monolithic drive shaft 10. As used herein, the term "monolithic drive shaft" means a drive shaft which is composed of a single piece of metal, that is, it is structurally substantially uniform. In other words, it is not segmented. The drive shaft 10 may be used, for example, in motors and to drive various devices. In preferred form, the drive shaft 10 is a propeller shaft for use in marine propulsion devices, for example, outboard or stern drive motors. As described more fully hereinafter, the drive shaft 10 is resistant to both wear and corrosion and is preferably manufactured from a metal having a predetermined surface hardness.

The drive shaft 10 comprises a proximal end portion 12 and a distal end portion 14. The proximal end portion 12 comprises a metal bearing surface portion 16. The metal bearing surface portion 16 corresponds to that portion of the drive shaft 10 which in use is in contact with other metal structures that are generally associated with driving the shaft, including driving gears, bearings, and the like.

The metal bearing surface portion 16 has a surface hardness which is greater relative to the surface hardness of the distal end 14. This greater surface-hardness is provided by exposure of the metal bearing surface portion 16 to a surface-hardening agent (described more fully hereinafter). Due to the greater surface hardness, the metal bearing surface 16 possesses improved resistance to various forms of wear, including galling, abrasive and frictional wear.

In the presently preferred embodiment, the metal bearing surface portion 16 include splines 18 and needle-bearing surfaces 20, 22, 24. In use,, the splines 18 are drivingly engaged to a gear means (not shown) which drives the drive shaft 10. In use also, the needle-bearing surfaces 20, 22, 24 are engaged frictionally to roller needle bearings (not shown).

The distal end portion 14 comprises a corrosive environment contacting portion 26. The corrosive environment contacting portion 26 corresponds to that portion of the drive shaft 10 which in use is exposed to an environment which is substantially corrosive relative to the environment to which in use the metal bearing surface 16 is exposed.

The corrosive environment contacting portion 26 has a surface which is more resistant to corrosion relative to the surface of the proximal end portion 12. Accordingly, the corrosive-environment contacting portion 26 possesses improved resistance to corrosion, for example, from marine environments.

In the presently preferred embodiment, the distal end portion 14 includes splines 28 and threaded portion 30. In use, the splines 28 are engaged to a means for generating motion, for example, a propeller means (not shown). The propeller means is preferably held in place with a locknut (not shown) that is mounted on the threaded portion 30.

Figure 4:
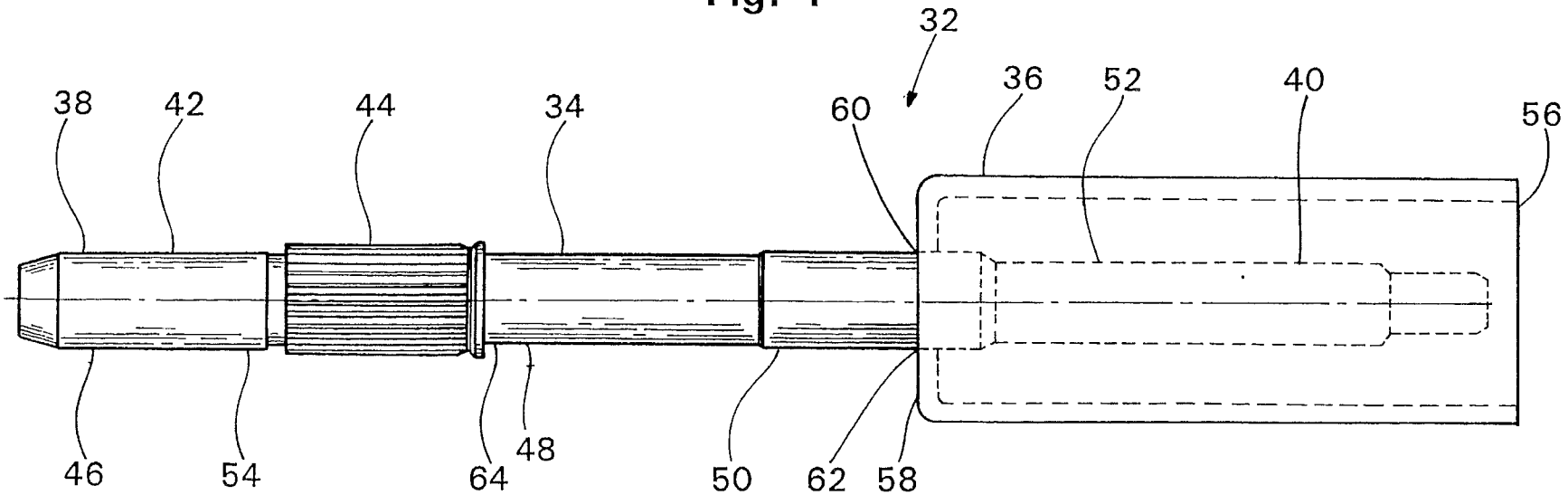
FIG. 4 is a plan view of a propeller shaft which includes a protective enclosure in accordance with the method aspects of the invention.

With particular reference to FIG. 4, there is provided a description of a process for producing the drive shafts of the invention as exemplified by the drive shaft 10. FIG. 4 shows a plan view of a protected drive shaft assembly 32. The protected drive shaft assembly 32 comprises a corrosion-resistant drive shaft 34 and a protective enclosure 36.

The corrosion-resistant drive shaft 34, which is used to produce the corrosion- and wear-resistant drive shafts of the invention, as exemplified by the drive shaft 10, is preferably manufactured from a metal that is substantially hard and substantially resistant to corrosion. It is preferred also that the metal from which the corrosion-resistant drive shaft 34 is manufactured is capable of being surface-hardened. Such metals include for example, alloys, such as stainless steel. A particularly suitable stainless steel from which the corrosion-resistant drive shaft 34 is manufactured is 17-4PH SS which is commercially available from Carpenter Steel of Reading, Pa.

Most of the austenitic, ferritic, and precipitation hardening grades of stainless steels are suitable for use in this invention. Austenitic grades are the 300 series stainlesses, ferritic grades include types 405, 430 and 443 stainlesses. Precipitation hardening grades include Carpenter grades Custom 450, Custom 455, 15-5PH and PH13-8Mo.

The corrosion-resistant drive shaft 34 includes a proximal end portion 38 and a distal end portion 40 which is shown by dashed lines. As with the proximal end portion 12 of the drive shaft 10, the proximal end portion 38 of the drive shaft 34 comprises a metal bearing surface portion 42 which in use is subjected to a substantially wearing environment. In the present embodiment, the metal bearing surface portion 42 includes splines 44 and needle bearing surfaces 46, 48, 50.

As with the distal end portion 14 of the drive shaft 10, the distal end portion 40 of the drive shaft 34 comprises a corrosive environment contacting portion 43 which in use is exposed to an environment that is substantially corrosive relative to the environment to which in use the metal bearing surface portion 42 is exposed. Although not shown, it is contemplated that the distal end portion 40 includes means, for example, splines and a lock-nut threaded portion, for engaging a motion-generating means, for example, a propeller means. Such splines and lock-nut threaded portion are preferably similar to splines 28 and threaded portion 30 which were described above in connection with the drive shaft 10.

The corrosion-resistant drive shaft 34 is preferably manufactured to have a predetermined surface hardness. The surface hardness is preferably uniform throughout the drive shaft 34. Preferably, the corrosion-resistant drive shaft 34 has a predetermined surface hardness of about 28–37 Rc scale, measured accordingly to the following standard: ASTM standard E-18, standard methods of test for Rockwell hardness and Rockwell superficial hardness of metallic materials.

The portion of the drive shaft 34 which is covered by the protective enclosure 36 is referred to herein as protected drive shaft portion 52. The portion of the drive shaft 34 which is not covered by the protective enclosure 36 is referred to herein as unprotected drive shaft portion 54. The protected drive shaft portion 52 corresponds to that portion of the drive shaft 34 which in use is engaged to a motion-generating means, for example, a propeller means. The unprotected drive shaft portion 54 corresponds to that portion of the drive shaft 34 which includes metal bearing surface portion 42 for frictionally contacting other metal surfaces, for example, gear means and needle roller bearings.

The size and shape of the protective enclosure 36 is not critical and may be selected as desired. It is advantageous that the size and shape of the protective enclosure 36 is such that the protected drive shaft portion 52 corresponds substantially to that portion of the drive shaft 34 which in use is exposed to an environment which is more corrosive than the environment to which in use the unprotected drive shaft portion 54 is exposed. It is also advantageous that the size and shape of the protective enclosure 36 is such that the unprotected drive shaft portion 54 corresponds to that portion of the drive shaft 34 which in use is subjected to wearing conditions resulting from, for example, frictional contact with metal surfaces, such as gear means and needle roller bearings. In addition, it is preferred that the size and shape of the protective enclosure 36 is such that the unprotected drive shaft portion corresponds to that portion of the shaft which in use is exposed to an environment that is less corrosive than the environment to which the protected drive shaft portion 52 is exposed.

In the presently preferred embodiment, the protective enclosure 36 is substantially cylindrical and comprises a closed end 56 and an end 58 which includes an aperture 60 to accommodate the distal end portion 40 of the drive shaft 34. Also in the presently preferred embodiment, the protective enclosure 36 is substantially coaxial with the drive shaft 34.

The protective enclosure 36 is slidably and removably mounted via the aperture 60 onto the distal end portion 40 of the drive shaft 34. Preferably, the diameter of the aperture 60 is greater than the largest diameter of the protected drive shaft portion 52. The protective enclosure 36 is thereby readily mounted slidably and removably on the drive shaft 34. However, it is desirable also that the protective enclosure 36 and the protected drive shaft portion 52 be substantially close-fitting. A close fit is desirable particularly at the juncture 62 of the aperture 60 with the drive shaft 34. Such a close fit substantially prevents introduction of the surface-hardening agent (described more fully hereafter) into the aperture 60. This would result in contact of the surface-hardening agent with the protected drive shaft portion 52, thereby causing undesired surface hardening and diminished corrosion-resistance of the protected drive shaft portion 52.

The protective enclosure 36 is preferably made from a material which is capable of preventing contact of the surface-hardening agent with the protected drive shaft portion 52 of the drive shaft 34 when the protective enclosure 36 is slidably mounted thereon. Preferred materials from which the protective enclosure 36 is made include materials which are substantially durable to permit repeated use of the protective enclosure 36. Examples of suitable materials from which the protective enclosure 36 can be made include stainless steel and ceramic.

Prior to subjecting the protected drive shaft assembly 32 to surface-hardening conditions, a packing sealant material (not shown) may be applied to the juncture 62 of the drive shaft 34 and the aperture 60 of the protective enclosure 36. If applied, the packing sealant material would substantially completely prevent introduction of the surface-hardening agent into the aperture 60. Examples of suitable packing sealant materials include graphite gaskets and ceramic fibers impregnated with commercially available "stop-off" liquids that provide barriers to atmosphere penetration. In certain types of furnace surface hardening treatments, the packing can be eliminated completely (i.e., plasma nitriding).

The protected drive shaft assembly 32 is then subjected to surface-hardening processes to provide the corrosion- and wear-resistant drive shafts of the present invention. Such surface-hardening processes are known to those skilled in the art and typically involve exposing the protected drive shaft assembly 32 to one or more surface-hardening agents at a temperature and for a time to provide the corrosion- and wear-resistant drive shafts of the invention, as exemplified by the drive shaft 10.

Examples of surface-hardening processes for use in the method aspects of the present invention include the following:

(A) carburizing, which involves diffusing nascent carbon into a steel surface;

(B) carbonitriding, which involves the simultaneous absorption into carbon and alloy steels of both carbon and nitrogen;

(C) cyaniding, which is the liquid-bath form of carbonitriding;

(D) nitriding, which involves addition and diffusion of nascent nitrogen into the surface of steel where it reacts to form nitrides; and (E) applied-energy hardening.

Although any of techniques (A) to (E) may be used for hardening the surface of the unprotected drive shaft portion 52 of the protected drive shaft assembly 32, process (D), nitriding, which can be accomplished by using either a gas atmosphere (plasma) or a liquid bath, is preferred. Plasma nitriding is particularly preferred for use in the methods of the present invention and results in improved slide wear qualities and increased strength of the unprotected drive shaft portion 54.

Plasma nitriding is a technique which is well know to those skilled in the art and is accomplished industrially through an ion nitriding procedure. By ion nitriding, the wear resistance of the drive shaft 34 is substantially improved, with minimal dimensional and roughness changes. There is also comparatively high ductility and impact strength in the nitrided drive shaft.

Nitriding treatment periods and nitriding temperatures of the protected drive shaft assembly 32 may vary, and depend upon the material being nitrided, the desired hardness and the nitriding hardness depth. The unprotected drive shaft portion 54 of the drive shaft 34 is preferably surface hardened to a Rockwell hardness of at least about $58R_c$. In preferred embodiments, the unprotected drive shaft portion 54 is surface-hardened to a Rockwell surface hardness of about $55R_c$ to about $65R_c$ and, most preferably, of about $58R_c$ to about $62R_c$. In addition, the unprotected drive shaft portion 54 is preferably surface-hardened to a hardness depth of at least about 0,003", with a hardness depth of about 0,005" being preferred.

Generally, nitriding treatment periods range from about a few hours to about 48 hours. Nitriding is generally also conducted at an elevated temperature, for example, from about 750° F. to about 1100° F. With particular reference to the methods of the present invention, the protected drive shaft assembly 32 is exposed to ion nitriding conditions for a period of time of about 20 hours to about 40 hours, with a period of time of about 25 hours to about 30 hours being preferred. In addition, the ion nitriding processes of the present invention involve heating the protected drive shaft assembly 32 to a temperature of about 930° F. to about 1100° F., with a temperature of about 975° F. to about 1020° F. being preferred.

It has been reported that nitriding results may be improved by finishing and/or cleaning the surface of a workpiece prior to conducting the nitriding process. Accordingly, finishing and/or cleaning of the surface of the unprotected drive shaft portion 52 may be conducted prior to nitriding. Such finishing and/or cleaning of the unprotected portion 32 may involve: chemical activation using an acid bath; abrasive cleaning using a fine aluminum oxide grit; or polishing using ultrafine sandpapers.

After surface-hardening of the protected drive shaft assembly 32, the protective enclosure 36 is removed. The resulting drive shaft comprises a surface-hardened metal-bearing surface portion 64 and a corrosive environment contacting portion which is not shown but which is substantially similar to the corrosive environment contacting portion 26 of the drive shaft 10. The surface-hardened and corrosion resistant drive shaft may be used immediately. Alternatively, the surface of the drive shaft, and particularly the surface which corresponds to the unprotected portion 54 prior to nitriding, may be lapped and/or polished, or subjected to other post-nitriding operations.

Embodiments of the present invention are described in the following non-limiting examples which include a description of the preparation of a nitrided propeller shaft.

EXAMPLE

A stainless steel (17-4PH SS) propeller shaft (276 mm in length) is hardened and tempered (H1150). Grease, oil and other contaminants are removed from the shaft with a cleaning agent which does not contain compounds that inhibit nitriding. The surface of the shaft is activated by furnace activation. A protective enclosure in the form of a close-fitting stainless steel cylindrical mask is placed over the end of the shaft which, in use, is proximate the propeller blades and is exposed to corrosive environments, including marine environments. Nitriding is then conducted in a controlled atmosphere furnace at 975° to 1020° F. for a period of time of about 28 hours to convert the expose surface portion to a nitriding surface having a desired surface hardness of about $60R_c$. The protective enclosure is removed, and the nitrided surface is ground, if desired, such that a maximum of 0.001" per side is removed.

The resulting propeller shaft comprises a first region and a second region. The first region corresponds to that portion of the shaft which is exposed to the nitriding atmosphere during the nitriding process. The first region has an increased surface hardness due to nitriding. The second region corresponds to that portion of the shaft which was protected from the nitriding atmosphere by the protective enclosure. The surface of the second region is passive and free from nitrides. In use, the first region exhibits desirable galling and wear resistance, and the second region exhibits desirable corrosion resistance.

We claim:

1. A monolithic metallic drive shaft which is resistant to corrosion and which comprises proximal and distal end portions, each of said proximal and distal end portions having a predetermined surface hardness, wherein the surface hardness of one of said proximal and distal end portions is greater than the surface hardness of the other of said proximal and distal end portions.

2. The drive shaft according to claim 1 wherein said metal comprises stainless steel.

3. The drive shaft according to claim 1 wherein said end portion which has a greater surface hardness comprises a bearing surface.

4. The drive shaft according to claim 3 wherein said bearing surface comprises a metal bearing surface.

5. The drive shaft according to claim 4 wherein said metal bearing surface comprises a needle bearing surface.

6. The drive shaft according to claim 1 wherein said drive shaft comprises a propeller shaft.

7. A corrosion-resistant, monolithic metallic drive shaft for a marine propulsion device comprising a first portion which in use is subjected to a substantially corrosive environment and a second portion which includes a bearing surface and which in use is subjected to an environment which is less corrosive than the environment to which said first portion is subjected, said first portion comprising a first predetermined surface hardness and said second portion comprising a second predetermined surface hardness, wherein the surface hardness of said second portion is greater than the surface hardness of said first portion.

8. The drive shaft according to claim 2 wherein propeller means is mounted on said first portion and said second portion is surface hardened.

9. The drive shaft according to claim 8 wherein said second portion is nitrided.

10. The drive shaft according to claim 7 wherein said predetermined surface hardness of said first portion is about $32R_c$ and said predetermined surface hardness of said second portion is about $60R_c$.

11. The drive shaft according to claim 7 wherein said first portion is subjected to a marine environment.

12. The drive shaft according to claim 7 wherein said marine propulsion device comprises an outboard or stern drive motor.

13. A process for producing a drive shaft comprising providing a corrosion-resistant, monolithic metallic shaft comprising a first portion which in use is subjected to a substantially corrosive environment and a second portion which includes a bearing surface and which in use is subjected to an environment which is less corrosive than the environment to which said first portion is subjected, and surface hardening said second portion.

14. The process according to claim 13 wherein said surface hardening of said second portion involves a process which is selected from the group consisting of carburizing, carbonitriding, cyaniding, nitriding and applied-energy hardening.

15. The process according to claim 14 comprising nitriding said second portion.

16. The process according to claim 13 comprising protecting said first portion with a protective enclosure to provide a protected shaft and surface hardening said protected shaft.

17. The process according to claim 16 comprising nitriding said protected shaft.

18. The process according to claim 17 comprising nitriding said protected shaft at a temperature of about 975° F. to about 1020° F.

19. The process according to claim 18 comprising nitriding said protected shaft for a period of time of about 25 hours to about 30 hours.

20. A process for producing a drive shaft comprising providing a corrosion-resistant, monolithic metallic shaft comprising a first portion which in use is subjected to a substantially corrosive environment and a second portion which includes a bearing surface and which in use is subjected to an environment which is less corrosive than the environment to which said first portion is subjected, and nitriding said second portion.

* * * * *